US011576508B2

(12) United States Patent
Ruefiel

(10) Patent No.: US 11,576,508 B2
(45) Date of Patent: Feb. 14, 2023

(54) RESTING PILLOW WITH INTEGRATED HEADPHONES

(71) Applicant: TranspacificTechnologies, LLC, Rochester Hills, MI (US)

(72) Inventor: Joseph Ruefiel, Rochester Hills, MI (US)

(73) Assignee: Transpacific Technologies, LLC, Rochester Hills, MI (US)

( * ) Notice: Subject to any disclaimer, the term of this patent is extended or adjusted under 35 U.S.C. 154(b) by 202 days.

(21) Appl. No.: 16/021,406

(22) Filed: Jun. 28, 2018

(65) Prior Publication Data

US 2020/0000256 A1 Jan. 2, 2020

(51) Int. Cl.

| | |
|---|---|
| ***A47G 9/10*** | (2006.01) |
| ***A47C 7/38*** | (2006.01) |
| ***A47G 9/00*** | (2006.01) |
| ***H04R 5/02*** | (2006.01) |

(52) U.S. Cl.

CPC ..... *A47G 9/1045* (2013.01); *A47C 7/383* (2013.01); *A47G 9/1081* (2013.01); *H04R 5/023* (2013.01); *A47G 2009/006* (2013.01)

(58) Field of Classification Search

CPC ..... A47G 9/1045; A47G 9/1081; A47G 2009/006; B60R 2011/0017; H04R 5/023

USPC ..... D6/601

See application file for complete search history.

(56) References Cited

U.S. PATENT DOCUMENTS

| | | | | |
|---|---|---|---|---|
| 5,313,678 | A * | 5/1994 | Redewill | A47C 21/003 297/393 |
| 6,098,220 | A * | 8/2000 | Momma | A47G 9/1009 5/636 |
| 8,674,211 | B1 | 3/2014 | Palmer et al. | |
| 2009/0144887 | A1 | 6/2009 | Orandi | |
| 2009/0224722 | A1 | 9/2009 | Causey | |
| 2012/0042996 | A1 | 2/2012 | Glynn | |
| 2013/0238829 | A1* | 9/2013 | Laycock | H04R 1/1033 710/303 |
| 2014/0007351 | A1* | 1/2014 | Cohen | A47G 9/10 5/639 |
| 2017/0069318 | A1* | 3/2017 | Hardman | A47G 9/1045 |
| 2017/0088266 | A1* | 3/2017 | Tracy | B64D 11/00154 |
| 2018/0325292 | A1* | 11/2018 | Kassab Arabo | A47G 9/066 |
| 2019/0182593 | A1* | 6/2019 | Guerrini | H04S 7/302 |
| 2019/0223602 | A1* | 7/2019 | Radke | A47C 7/383 |

(Continued)

FOREIGN PATENT DOCUMENTS

CN 103082507 12/2014

OTHER PUBLICATIONS

Will Palmer, The Best Headphones of 2017, May 23, 2017, Outside, outsideonline.com/2183191/best-headphones-2017. Accessed Apr. 10, 2020. (Year: 2017).*

(Continued)

*Primary Examiner* — Peter M. Cuomo
*Assistant Examiner* — Amanda L Bailey
(74) *Attorney, Agent, or Firm* — Harness, Dickey & Pierce, PLC

(57) ABSTRACT

A resting pillow is disclosed. The resting pillow incorporates headphones as part of the pillow body. The headphones are in communication with electronic communication device, which is configured to send and/or receive wireless signals from an external personal portable electronic device.

14 Claims, 2 Drawing Sheets

(56) References Cited

U.S. PATENT DOCUMENTS

2019/0350389 A1* 11/2019 Sutton, Jr ..... A63H 3/005

OTHER PUBLICATIONS

"Headphone and earphone cable materials: Tpe,Tpu", Li Nx. 2014, accessed Jul. 2021, https://owl.purdue.edu/owl/research_and_citation/mla_style/mla_formatting_and_style_guide/mla_works_cited_electronic_sources.html (Year: 2014).*

* cited by examiner

RESTING PILLOW WITH INTEGRATED HEADPHONES

BACKGROUND

Resting pillows are commonly used by passengers on commercial airplanes to support the passenger's head and better enable the passenger to sleep upright. A variety of resting pillows in different configurations are commercially available. Resting pillows are commonly made of a soft or plush material with stuffing therein. They are typically configured to wrap around a person's neck, though several variations are known. Resting pillows can also be used by people who work for extended periods in front of a computer screen, and especially those who attend online video meetings and/or those who take online classes.

A common way for airplane passengers to pass the time of a flight is to watch movies or television shows or to listen to music, all of which require the passenger to use headphones or ear buds. People who attend online video meetings and/or take online classes typically use headphones or earbuds along with a microphone (mic) to communicate with other remote participants in the online video conference and/or online class. The headphones or ear buds can either be of the wired or wireless variety. If wired, the headphones or ear buds plug into an external device (e.g., smart phone, mp3 player, tablet, computer, etc.) or into the entertainment system of the airplane. If wireless, the headphones or ear buds communicate with such external devices using any available wireless technology, such as Blue Tooth.

Airline passengers and those who use computers for online meetings and classes sometimes experience difficulties with their headphones and ear buds. Sometimes airline passengers forget to bring them on the trip. Sometimes the long wires of the headphones or earbuds can be cumbersome and get in the way in the very small seating of airplanes. Sometimes a user prefers larger headphones (which may have better sound quality) to ear buds, but the use of larger headphones interfere with the resting pillow, causing the user to have to choose between using the resting pillow and using his/her preferred larger headphones.

Accordingly, there is a need for an improved product that provides travelers and those who take online classes and attend online conferences with the benefits of a resting pillow and makes listening to audio, e.g., movies, television shows, music and meetings/classes) as simple and convenient as possible.

SUMMARY

A new resting pillow is disclosed. The resting pillow includes a tubular resting pillow body that is substantially circular with an opening that enables it to be wrapped around a person's neck and support the person's head when the person is positioned upright. The resting pillow body has a wireless transceiver embedded therein that is configured to receive and/or send wireless audio signals to/from an external source. The resting pillow also includes headphones that are seated in the ends of the resting pillow body. The headphones are selectively extendable from and retractable into the respective ends of the pillow body.

DETAILED DESCRIPTION OF DRAWINGS

DETAILED DESCRIPTION

Figure 1:
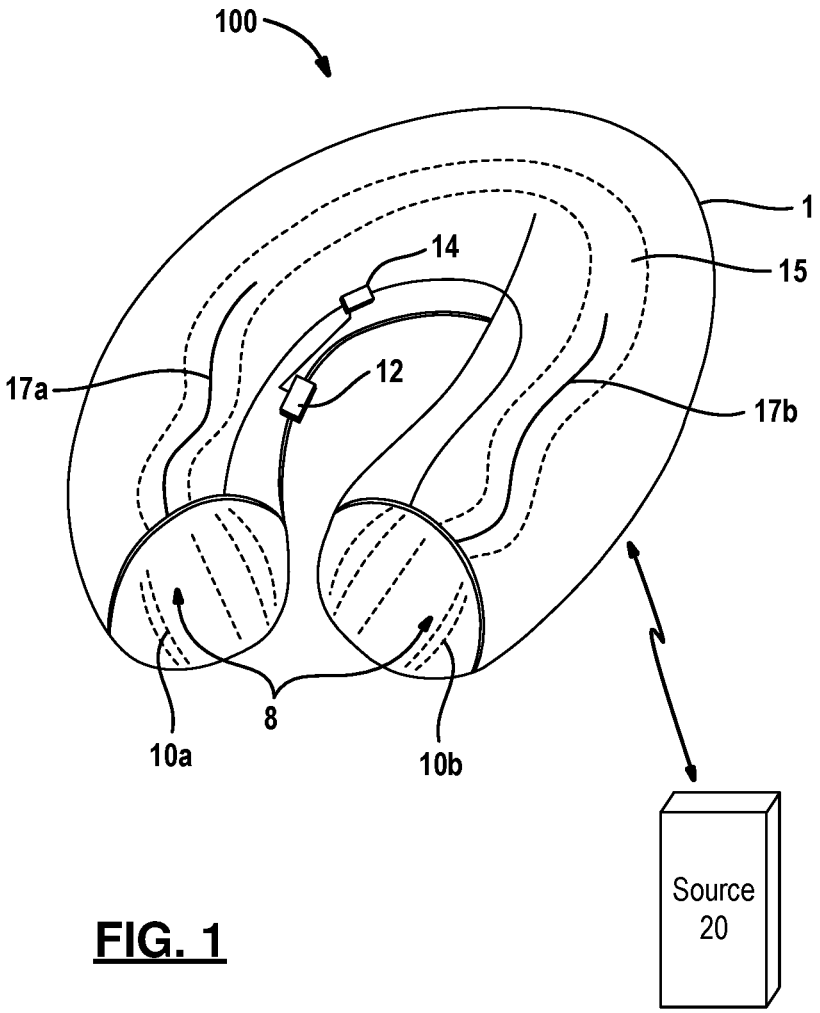
FIG. 1 illustrates an embodiment of a resting pillow having an integrated set of headphones and mic, according to an embodiment of the invention.

A resting pillow 100 with an integrated set of headphones is disclosed. FIG. 1 illustrates an exemplary embodiment of the resting pillow 100. Resting pillow 100 includes a body portion 1 that is approximately tubular in shape and substantially forms a circle. The exemplary resting pillow body 1 includes a narrow opening through which a person's neck can slide to position the resting pillow. The body portion 1 is configured to substantially wrap around a person's neck to support the person's head from falling to one side or another as the person sits or sleeps in an upright position for prolonged amount of time. The exemplary resting pillow body 1 shown in FIG. 1 includes an outer skin made from a fabric and a stuffing material inside of the outer skin that makes the pillow soft and malleable, but yet supportive. Other variations of the travel pillow body 1 are contemplated by this invention and no specific configuration of a resting pillow body is required The body portion 1 includes two end portions 8 that flank the opening through which a person's neck can slide to position the resting pillow. The end portions 8 are preferably configured to oppose or point at each other. The end portions 8 are hollow and house audio delivery devices, such as speakers, headphones and the like. Preferably, the audio delivery devices are substantially round headphones 10*a* and 10*b*. The headphones 10*a* and 10*b* are configured to be selectively retracted and seated in and extended from the hollow end portions 8 of the pillow body 1. Each headphone 10*a* and 10*b* may have a handle that is used to pull from the respective headphone from its seated position in the end portion 8 of the pillow body 1. The pillow body 1 further includes a microphone 12 embedded therein and positioned so as to be able to pick up words spoken by the person using the resting pillow. The pillow body 1 further includes a transceiver 14 in the pillow body 1 (as illustrated) or integrated into the headphones 10*a*, 10*b* that is configured to receive audible signals from an external source 20 and to transmit audible signals from the microphone 12 to the external source 20. The electronic components in the resting pillow 100 may be powered by batteries, which may be replaceable and may also be rechargeable. The resting pillow may include a charging port to re-charge the rechargeable batteries.

Now the extension and retraction of the headphones 10*a*, 10*b* from the pillow body 1 is explained in more detail. Each headphone 10*a* and 10*b* has attached to its rear surface a semi-rigid, elongated "s-shaped" extension 17*a* and 17*b*. The extensions 17*a*, 17*b* may resemble a tube or wire with one or more turns or curves therein. The extensions 17*a* and 17*b* are flexible and resilient such that they can be temporarily deformed when a force is applied and then return to their original shape. When headphones 17*a* and 17*b* are in their seated positions in the hollow end portions 8 of pillow body 1, the extensions 17*a* and 17*b* extend back into the pillow body 1 inside of a channel 15, which has a shape that mirrors that of the extensions 17*a* and 17*b*. Accordingly, when the headphones 10*a* and 10*b* are seated in the end portions 8, the shape of the extensions 17*a* and 17*b* match the shape of the channel 15, and, consequently, hold the headphones 10*a* and 10*b* in place in the end portions 8.

Figure 2:
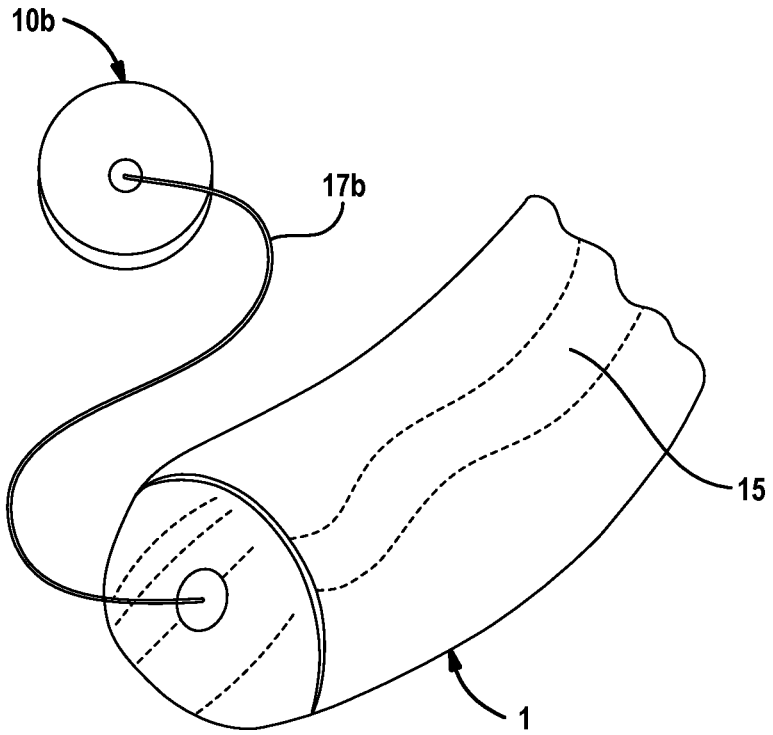
FIG. 2 illustrates a cut-away of one of the arms of the resting pillow of FIG. 1 and showing the associated headphone extended from the resting pillow body.

When a person desires to extend the headphones 10*a* and 10*b* from the end portions 8, the person can use a handle to pull the headphones 10*a* and 10*b* from the end portions 8. The extensions 17*a* and 17*b* will temporarily deform and pass through the channel 15 as the headphones 10*a* and 10*b* extend outward. FIG. 2 illustrates one arm of the pillow body 1 with the headphone 10*b* extended from the pillow body 1. As illustrated, once headphone 10*b* is extended, extension 17*b* maintains its rigid "S" shape once outside of the channel 15.

When a person desires to retract the headphones 10*a* and 10*b* back into the pillow body 1 so that they are seated in the hollow end portions 8, the person applies a small pressure to the rigid extensions 17*a* and 17*b*, pushing them back toward the hollow end portions 8. The extensions 17*a* and 17*b* will temporarily deform somewhat as they are pushed back through channel 15. Once headphones 10*a* and 10*b* reach their seated position in the end portions 8, the extensions 17*a* and 17*b* will be within channel 15 in the portions that mirror the "S" shape of the extensions 17*a* and 17*b*.

Figure 3:
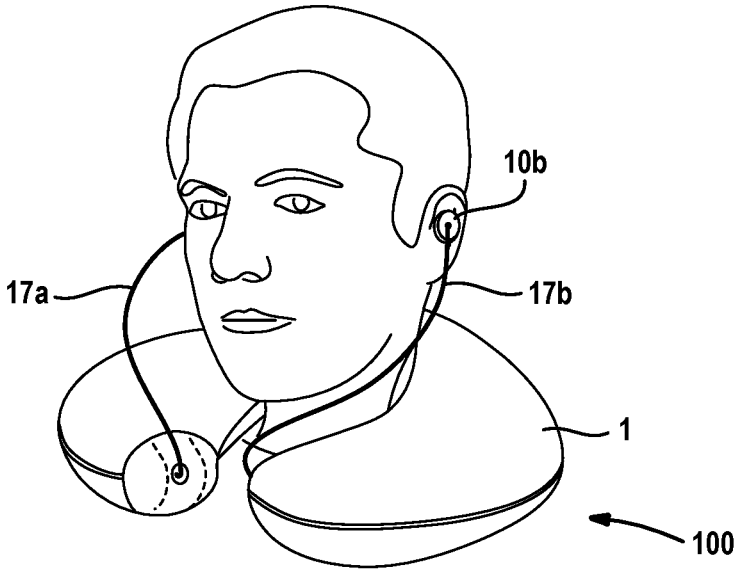
FIG. 3 illustrates the resting pillow of FIG. 1 wrapped around a person's neck while in use, with the removable headphones extended and positioned on the person's ears.

FIG. 3 illustrates the travel pillow 100 in use, surrounding the neck of a person. The headphones 17*a* (not shown) and 17*b* are extended from the pillow body 1 and shown positioned over the person's ears. The rigidness of the "S"-shaped extensions 17*a* and 17*b* hold the headphones in place of the person's ears.

The invention claimed is:

1. A resting pillow, comprising: an elongated, approximately circular pillow body configured to at least partially surround the neck of a human, said pillow body having first and second end portions that terminate opposite ends of the pillow body; a first headphone that is retractable toward and extendable from said first end portion; a second headphone that is retractable toward and extendable from said second end portion; at least one of the first and second headphones connected to an elongated, semi-rigid extension that is extendable from and retractable into a channel inside of the pillow body; a microphone embedded in the pillow body and configured to receive external audio information; an electronic communication device incorporated in the pillow body that is in communication with said first and second headphones, said microphone and an external source of input signals; wherein the semi-rigid extension has a non-linear shape along its length when not under an external force and the channel has a non-linear shape along its length that at least approximates the non-linear shape of the semi-rigid extension; and wherein the semi-rigid extension is configured to cooperate with the channel to hold the headphone in a seated position adjacent the pillow body when the semi-rigid extension is retracted into the channel and to temporarily deform in response to a pulling force on the headphone away from the first end portion so as to enable the semi-rigid extension to pass through the channel and permit the headphone to be pulled away from the seated position.

2. The resting pillow of claim 1, wherein the input signals are wireless signals representative of audio data.

3. The resting pillow of claim 1, wherein said communication device is an electronic transceiver configured to receive wireless signals from the external source of input signals and to transmit wireless signals to the external source of input signals.

4. The resting pillow of claim 1, wherein said communication device is a personal portable electronic device.

5. The resting pillow of claim 1, wherein said electronic communication device is an electronic transceiver configured to receive wireless signals from the external source of input signals and to transmit wireless signals representative of the external audio information to the external source of input signals.

6. The resting pillow of claim 1, wherein the semi-rigid extension is configured to hold the first headphone against a human user's ear when the first headphone is extended from the pillow body.

7. The resting pillow of claim 1, wherein the first end portion has a hollow end portion configured to seat the first headphone when it is retracted into the pillow body.

8. The resting pillow of claim 1, where the non-linear shape includes one or more curves.

9. The resting pillow of claim 8, wherein the non-linear shape is approximately an S-shape.

10. A resting pillow, comprising: an elongated, approximately circular pillow body configured to at least partially surround the neck of a human, said pillow body having first and second end portions that terminate opposite ends of the pillow body; a first headphone that is retractable toward and extendable from said first end portion; a second headphone that is retractable toward and extendable from said second end portion; at least one of the first and second headphones connected to an elongated, semi-rigid extension that is extendable from and retractable into a channel inside of the pillow body; wherein the semi-rigid extension has a non-linear shape along its length when not under an external force and the channel has a non-linear shape along its length that at least approximates the non-linear shape of the semi-rigid extension; and wherein the semi-rigid extension is configured to cooperate with the channel to hold the headphone in a seated position adjacent the pillow body when the semi-rigid extension is retracted into the channel and to temporarily deform in response to a pulling force on the headphone away from the first end portion so as to enable the semi-rigid extension to pass through the channel and permit the headphone to be pulled away from the seated position.

11. The resting pillow of claim 10, wherein the semi-rigid extension is configured to hold the first headphone against a human user's ear when the first headphone is extended from the pillow body.

12. The resting pillow of claim 10, wherein the first end portion has a hollow end portion configured to seat the first headphone when it is retracted into the pillow body.

13. The resting pillow of claim 10, where the non-linear shape includes one or more curves.

14. The resting pillow of claim 8, wherein the non-linear shape is approximately an S-shape.

* * * * *